US005649432A

United States Patent [19]

Cavalea, III

[11] Patent Number: 5,649,432

[45] Date of Patent: Jul. 22, 1997

[54] PORTABLE TEMPERATURE-CONTROLLED UNIT WITH MOVEABLY ATTACHED INSULATION

[76] Inventor: Anthony C. Cavalea, III, 15526 W. 139th St., Homer Township, Will County, Ill. 60441

[21] Appl. No.: 663,673

[22] Filed: Jun. 14, 1996

[51] Int. Cl.[6] ..... F25D 3/08

[52] U.S. Cl. ..... 62/457.1; 62/372; 220/1.5; 220/435

[58] Field of Search ..... 62/457.1, 457.9, 62/440, 239, 237, 259.1; 220/1.5, 435, 436, 437, 438, 439, 421, 445

[56] References Cited

U.S. PATENT DOCUMENTS

| | | | |
|---|---|---|---|
| 2,647,287 | 8/1953 | Jones | 20/4 |
| 2,984,084 | 5/1961 | Talmey et al. | 62/239 |
| 3,205,674 | 9/1965 | Arnold et al. . | |
| 3,296,756 | 1/1967 | Wade | 52/93 |
| 3,335,653 | 8/1967 | Heimann | 62/239 |
| 3,855,814 | 12/1974 | Eubank | 62/244 |
| 3,961,925 | 6/1976 | Rhoad | 62/376 |
| 4,223,500 | 9/1980 | Clark et al. | 52/309.4 |
| 4,622,832 | 11/1986 | Hagen | 62/344 |
| 4,662,189 | 5/1987 | Puppel | 62/449 |
| 4,773,230 | 9/1988 | Garrett | 62/237 |
| 4,800,733 | 1/1989 | Strobel et al. | 62/239 |
| 4,898,004 | 2/1990 | Richardson | 62/255 |
| 4,991,402 | 2/1991 | Saia, III | 62/52.1 |
| 5,245,838 | 9/1993 | Cavalea, III | 62/259.1 |

*Primary Examiner*—John M. Sollecito
*Attorney, Agent, or Firm*—Wallenstein & Wagner, Ltd.

[57] ABSTRACT

A portable, temperature-controlled container for temporary storage of perishable items for use at outdoor events, is disclosed. The portable, temperature-controlled container comprises a substantially rectangular container including a floor, a roof, and a plurality of connected walls. The walls include openings allowing access to the interior of the container for loading and unloading the container. The portable, temperature-controlled units are insulated with a "floating" insulation structure. The containers can be set up as individual units, or connected together forming a continuous series of easily accessible, temperature regulated units.

13 Claims, 3 Drawing Sheets

PORTABLE TEMPERATURE-CONTROLLED UNIT WITH MOVEABLY ATTACHED INSULATION

DESCRIPTION

1. Technical Field

The present invention pertains to a portable container, such as a cooler, freezer or heater, and more particularly, to a portable, self-contained, temperature-controlled container. The container is easily transported and can be set up individually or in a connected series, at outdoor sporting or entertainment events, or the like.

2. Background Prior Art

Many outdoor sporting or entertainment events, such as golf tournaments and concerts, provide food and refreshments for large numbers of people. Typically, where a large amount of food is served and sold, coolers, freezers and sometimes heaters are required for the temporary storage of perishable food and beverages.

Containers such as these, disclosed in commonly assigned U.S. Pat. No. 5,245,838, are suitable for temporary storage of perishable items. The containers, however, do not readily provide for loading and unloading of food and beverages from the container, such as with a forklift truck. Loading and unloading using a forklift truck may be desirable for speed and efficiency when the goods are palletized. Further, prior attempts at providing refrigerated or heated containers lead to the development of containers which, although portable, cannot be easily connected together providing a series of continuously accessible containers.

The present invention differs from the prior art in that it has the capability of being set-up either as a single unit, or as a series of containers connected, easily accessible from one-to-another. The present container is also easily accessible to handlers and forklift equipment for loading, unloading, and simply using the containers as freezers, refrigerators or heaters, at an outdoor event. The present invention provides a totally insulated container, with an insulation structure connected to, but independently movable from, the overall container structure. The insulation structure promotes energy efficiency and effective temperature control capability. The method of securing the insulation structure to the container also allows for customizing containers with a variety of insulation materials and thicknesses, depending upon the consumer's needs. The present invention provides these and other advantages, solving problems associated with the prior art units.

SUMMARY OF THE INVENTION

An object of the invention is to provide a portable, temperature-controlled container. In accordance with the invention, the portable, temperature-controlled container comprises a substantially rectangular container having a roof, a floor, and a plurality of separate walls, including at least a pair of longitudinally extending side walls and a pair of opposed end walls disposed adjacent to the side walls. The walls include a plurality of evenly spaced U-shaped, vertical or corrugation channels. The container includes at least one opening providing access to the interior space of the container. The container is insulated with an insulation structure which is secured to, yet independently movable from, the container walls.

Other features and advantages of the invention will be apparent from the following specification taken in conjunction with the following figures.

DETAILED DESCRIPTION

Figure 1:
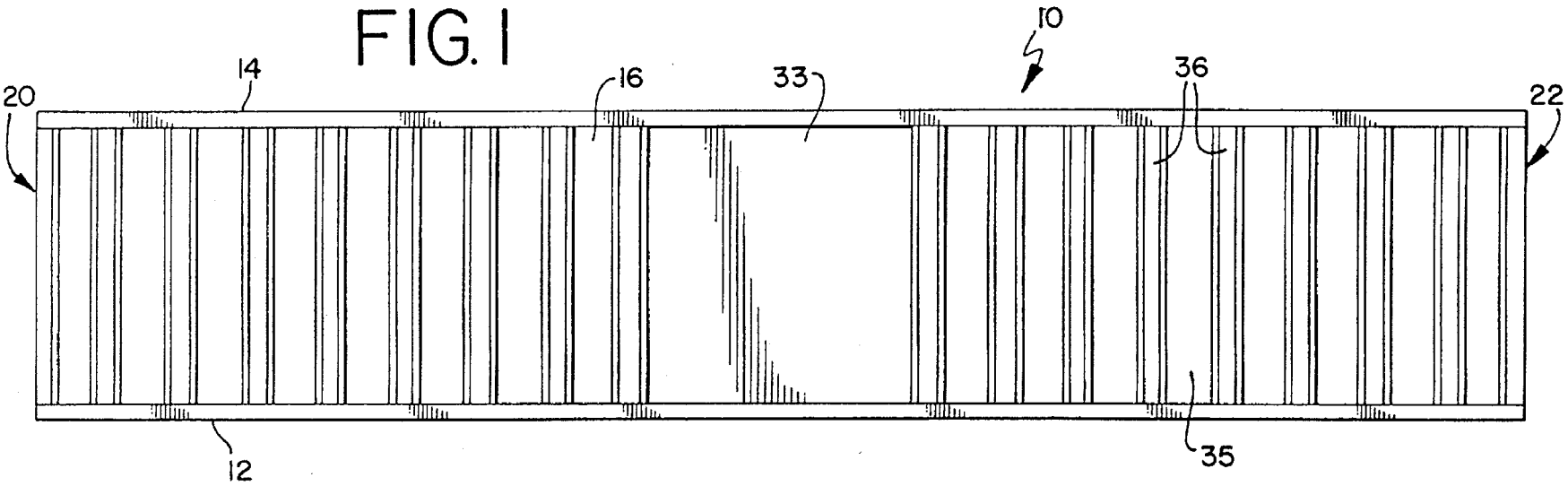
FIG. 1 is a side elevation view of a portable, temperature-controlled container made in accordance with the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiments illustrated.

A portable, temperature-controlled container, generally designated 10, is shown in FIG. 1. The container 10 is typically utilized to keep large amounts of perishable items preferably chilled, and/or frozen, at outdoor events, and is especially useful where the need for refrigeration or freezing is only temporary. Alternatively, the container 10 can also be used to keep food warm.

The container 10 is substantially rectangularly shaped in both plan and elevation, and comprises a floor 12, a roof 14, and a plurality of connected walls, including a pair of longitudinally extending side walls 16, 18, and a pair of opposed end walls including a front end wall 20 and a rear end wall 22.

The container 10 should be sturdy, yet lightweight enough to be easily and frequently transported to events using a flatbed trailer. The container 10 is typically a conventional overseas container, constructed of one of many types of lightweight, durable metal, such as is known in the art. Preferably the walls 35 of the container 10 are corrugated, defined by generally U-shaped vertical channels 36 extending from the roof 14 to the floor 12, for added strength, and for supporting the insulation structure 37 to be described. Additionally, the container 10 should be self-contained, with a temperature regulation unit 32 positioned within the container. Finally, the container 10 should be compact. To this end, it is preferred that doors on the container 10, when opened, are capable of being secured against the container, or stored within the container for improved appearance, convenience and safety. As will be described, the compact door arrangement also allows for a series of containers 10 to be placed side-by-side and connected together.

Figure 4:
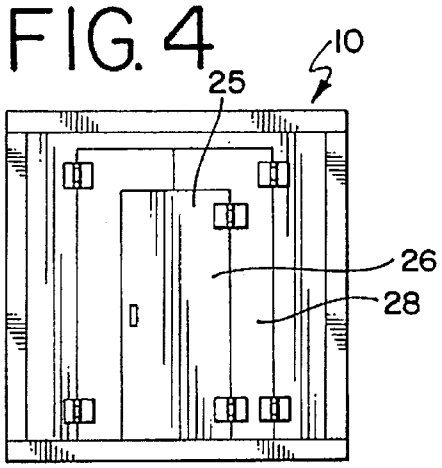
FIG. 4 is an end view of one end of the portable temperature-controlled container showing the outer door in an open position revealing the two inner doors.
Figure 2:
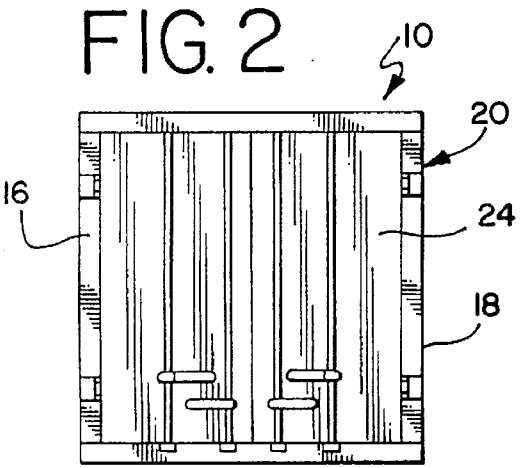
FIG. 2 is an end view of the container of FIG. 1 showing the outer door of the container.

As shown in FIGS. 2 and 4, a front end wall 20 of the container 10 is cooperatively formed by a set of double doors 24. Each one of the double doors 24 is hingedly attached to an edge of each one of the opposed, longitudinal side walls 16, 18. As illustrated in FIG. 4, the double doors 24 can be swung open and secured flush against the side walls 16, 18. A second set of doors 25 are located within the container 10, positioned slightly inward from the front of the container 10, providing a landing floor space 46, large enough to safely accommodate handlers and a forklift truck (not shown).

The second set of doors 25 comprises a first standard size service door 26 surrounded by a second larger freight door 28. The service door 26, is a standard size door through which a person can enter or exit the interior space of the container 10. The second, larger door 28 is approximately the size of the combined size of the outer set of double doors 24 in that it spans essentially the entire distance between the sidewalls 16 and 18. The larger freight door 28 is at least large enough that when opened, a forklift truck can enter the interior of the container 10 for loading and unloading palletized goods into and out of the container. Both the service door 26 and the freight door 28 are insulated. The service door 26 and the freight door 28 are conventional.

Figure 5:
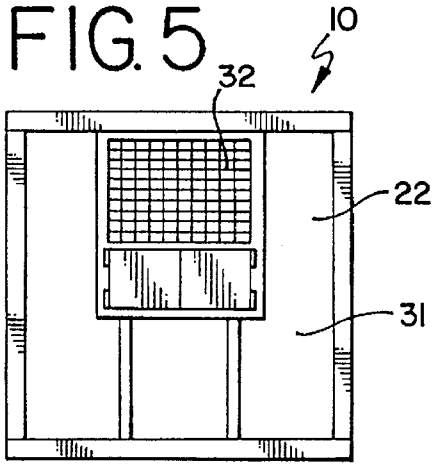
FIG. 5 is an end view of the container of FIG. 1 opposite the end shown in FIG. 2.
Figure 3:
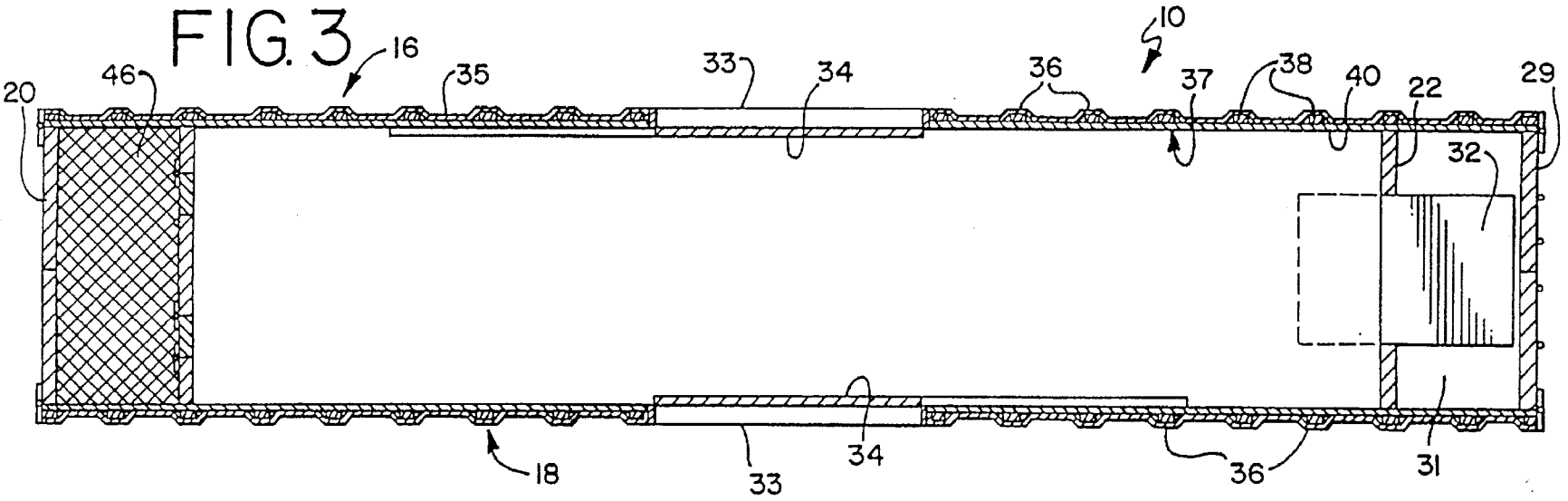
FIG. 3 is a top cut-away view of the portable temperature-controlled container of FIG. 1.

As illustrated in FIG. 3, the rear end wall 22 forming the back of the container 10, extends inwardly from the ends of the side walls 16, 18 defining a ventilation equipment area 31. The rear end wall 22 provides a supporting surface for mounting a temperature regulation unit 32, such as a refrigeration compressor, within the ventilation equipment area 31. The temperature regulation unit 32 is located within the interior of the container 10, with the exhaust portion of a temperature regulation unit exposed or vented to the outside, yet contained within the ventilation equipment area 31. The ventilation equipment area 31 provides protection to the temperature regulating unit 32 from weather and other hazards encountered during transport (FIG. 5). Optionally, another set of back doors 29 (FIG. 3), similar to the double doors 24 forming the front of the container 10, can be added to the back of the container to close the ventilation equipment area 31. The back doors 29 could be closed during transport of the container, providing complete protection to the temperature regulation unit 32. When the container 10 is in use, the back doors 29 can be swung back and secured against the container allowing for ventilation of the temperature regulation unit 32.

FIGS. 1 and 3 show a side opening 33 located in at least one, and preferably both of the two side walls 16, 18. The side opening 33 is covered by a side door 34. The side opening 33 is preferably positioned in the center of each of the side walls 16, 18, for ease of access to the interior of the container. Further, the side opening 33 is large enough to accommodate a forklift truck.

For compactness and convenience, the side door 34 is preferably a sliding door rather than a swinging door. The side door 34 is mounted for sliding in a horizontal direction such that when it is moved into an open position, the side door slides within and parallel to the interior wall 11 of the container 10. In this open, stored position, the side door 34 does not interfere with access to the interior of the container 10, nor does it interfere with positioning several containers side-by-side in a series.

Horizontal movement of the side door 34 provides an additional advantage over a standard swing door, especially when a series of containers 10 are connected together through the side opening 33. Containers 10 positioned side-by-side obviously limit the amount of space available between the containers, therefore, limiting or inhibiting the movability of a typical hingedly attached swing door. The advantage to the side door 34 is that it can be opened and closed without interference or inhibition from an adjacent container 10. Therefore, use of the horizontally sliding side door 34 permits a series of containers 10 to be connected together, yet providing the option of closing off and separating containers from one another in the series, without having to move or re-position the containers away from one another.

In order to maintain a constant, regulated temperature within the container 10, the container is insulated with an insulation structure 37. Insulation of the container 10 needs to be accomplished without piercing the outer container walls 35, as piercing may cause corrosion and expose the interior of the container to the environment. Both corrosion and outside exposure obviously decrease the temperature regulating efficiency of the container 10, as well as decrease the overall lifespan of the container. Further, the technique for installing the insulation structure 37 of the present invention provides a structure which is incorporated with, yet independently movable from the container walls 35.

Figure 6:
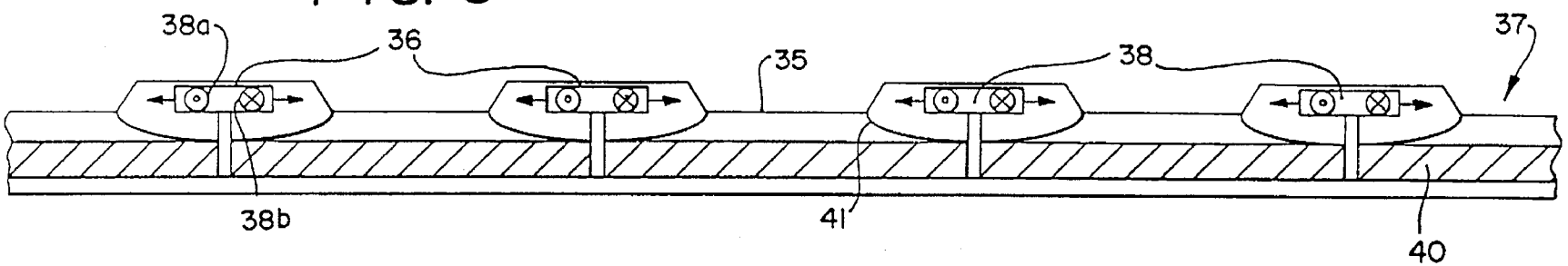
FIG. 6 is a cut-away view of a portion of one wall of the temperature-controlled container showing the insulation support structure; and, FIG. 7 is a view of a series of containers connected together.

As illustrated in FIG. 6, the container walls 35 are fabricated from corrugated sheeting material having a series of connected U-shaped vertical or corrugation channels 36. The corrugation channels 36 are spaced approximately 10 inches apart. The corrugation channels 36 are dimensioned to receive vertically extending 2 inch×4 inch vertical timbers or studs 38. Preferably, the studs 38 are positioned flush within the individual channels 36, and extend roughly the entire height of the container 10, from the roof 14 to the floor 12. The studs 38 are preferably 7 feet 6 inches long, leaving approximately a 1 inch clearance between the stud and the roof 14 and the floor 12 of the container 10. The studs 38 are positioned approximately within every second channel. The studs 38 are secured to the container walls 35 with a plurality of horizontally positioned, vertically spaced straps 41. Preferably, the straps 41 are made of thin strips of steel and are secured to the container walls 35 by welding across the stud 38 and across the corrugation channels 36, lashing the stud to the wall. The studs 38, however, are not held rigidly in place by the steel strap 41, but rather are free to "float" vertically within the corrugation channels 36 between the roof 14 and the floor 12. The studs 38 can also move slightly in the horizontal direction, limited by the width of the channels 36.

The studs 38 provide a base for securing any suitable insulation material 40, such as conventional wafer board to the container walls 35 in the interior of the container. The insulation material 40 is secured to the studs 38 using any conventional means such as nails or screws, driven through the insulation material into the studs 38, but not through the container walls 35. As discussed, use of the studs 38 avoids securing the insulation material 40 to the container walls 35, preventing corrosion areas in the container wall, which would interfere with effective temperature regulation within the container 10.

One advantage of the present invention is that the unique installation of the insulation structure 37 allows for customized containers, allowing the consumer the option to request a variety of insulation materials and thicknesses. Containers can be constructed on an individualized basis, depending upon the consumer's particular needs and requirements.

Another advantage of the insulation structure 37 is its ability to move independently of the container walls 35. Specifically, the container walls 35 have the freedom to flex during transport, separately from the insulation structure, which itself can move vertically or horizontally, independent from the container walls. Independent movement of these structures places less stress on both the container walls 35 and the insulation structure 37, avoiding potential damage to the walls or the insulation structure 37 during transport.

For convenience, space and efficiency, a self-contained, compact temperature regulation unit 32 is used. One example of a temperature regulating unit useful in the present invention is a refrigeration unit where the evaporator and compressor comprise a single unit, rather than a separate two-piece compressor and remote evaporator. A one-piece compact temperature regulation unit 32 avoids the need for extra pipe or conduit required for connecting the compressor to the evaporator, as required with a two-piece unit. A refrigerator evaporator/compressor 32 of the type useful in the present invention can be obtained from Thermo-King of Minnesota.

Figure 7:
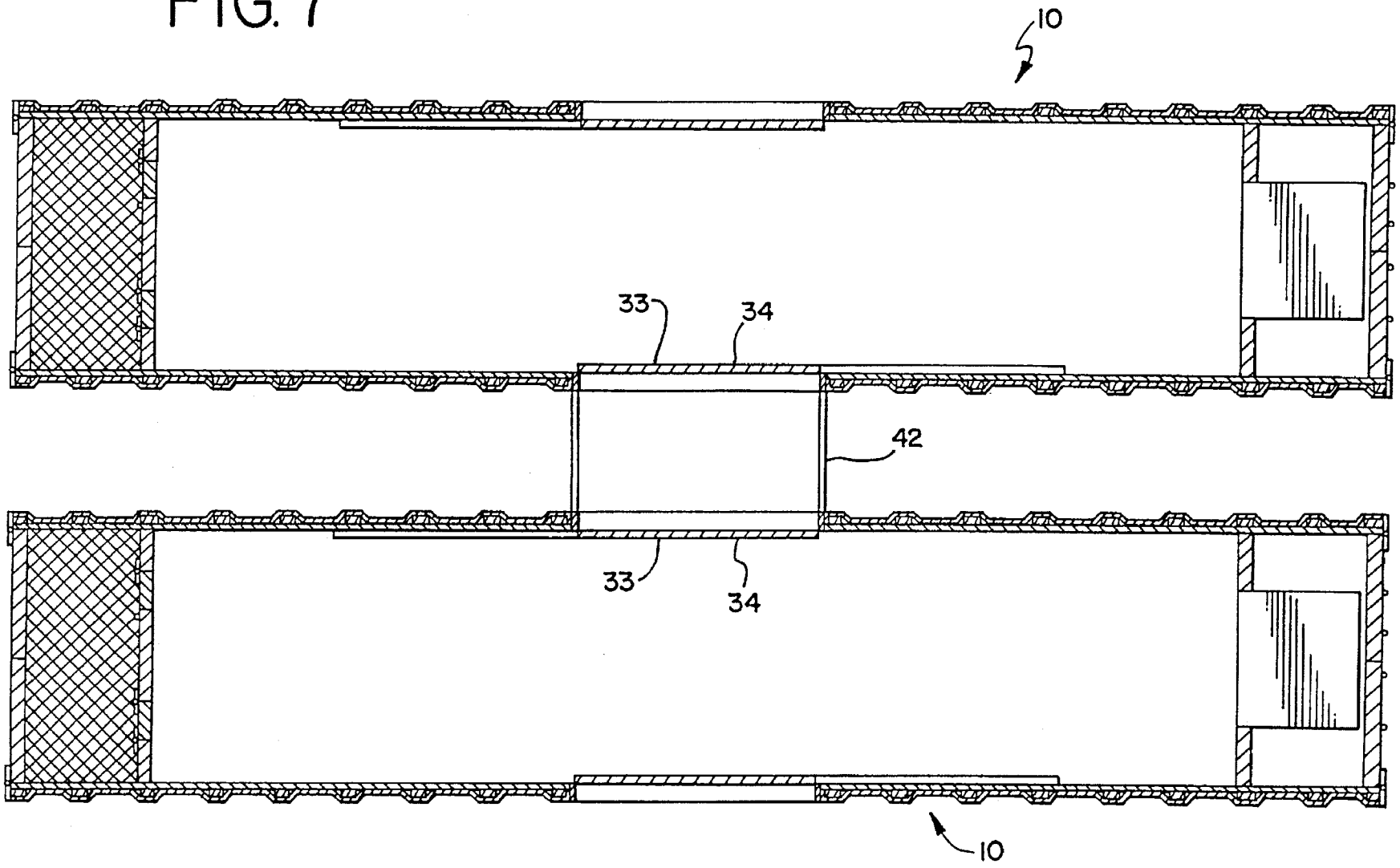

As shown in FIG. 7, and as described above, another advantage of the present invention over the prior art is that several containers 10 can be connected together forming a series of freezers, refrigerators or heaters, or even a variety of temperature-controlled containers in a continuous series. To achieve a series of containers accessible between one another, a temporary walkway 42 can be constructed between the center openings 33 to the containers using metal ramps. The temporary walkway 42 provides access to and through the series of containers 10, protecting the containers and handlers from the elements. Awning-type coverings (not shown) could also be placed over the walkways 38, or the walkways could be completely enclosed in a tent-like fashion to protect against the elements. Covered, and optionally insulated, the walkways 42 also assist in maintaining the temperature-controlled environment within the containers.

It will be understood that the invention may be embodied in other specific forms without departing from the spirit or central characteristics thereof. The present embodiment, therefore, is to be considered in all respects as illustrative and not restrictive, and the invention is not to be limited to the details given herein.

I claim:

1. A portable temperature-controlled container for transporting and temporary storage of perishable items comprising:

a substantially cubic container having a roof, a floor, and a plurality of connected walls, including at least a pair of longitudinally extending side walls and a pair of opposed end walls disposed adjacent to the side walls, the walls including a plurality of evenly spaced U-shaped vertical channels;

at least one opening providing access to an interior space of the container; and, an insulation structure movably attached to the walls for transverse movement between the roof and the floor for insulating the container.

2. The portable container of claim 1 further including a means for regulating the temperature of the container.

3. The portable container of claim 2 wherein the means for regulating the temperature of the container includes a self-contained temperature regulation unit.

4. The portable container of claim 1 wherein a first end wall is defined cooperatively by a pair of hingedly attached double doors.

5. The portable container of claim 4 wherein at least one opening is positioned behind the first end wall and is defined by a first door and a second door, the first door being hingedly attached to the second door.

6. The portable container of claim 4 wherein a second, supporting end wall supports the temperature regulating unit completely within the container in a location spaced from the floor.

7. The portable container of claim 6 wherein the second, supporting end wall is positioned inwardly from the ends of the longitudinally extending side walls.

8. The portable container of claim 1 wherein the insulation structure is attached to the walls with a support structure comprising a plurality of horizontally spaced and vertically extending studs positioned within the U-shaped channels; and means for attaching the studs to the walls without piercing the walls of the container.

9. The portable container of claim 8 wherein the means for attaching the studs to the wall comprises a metal strap positioned transverse to each of the studs and attached to the wall on opposite sides of the U-shaped channel.

10. The portable container of claim 9 wherein the straps are attached to the channel by welding.

11. The portable container of claim 1 further including a means for connecting each of the containers to form a series of walk-through structures.

12. The portable container of claim 11 wherein the container connecting means comprises at least one centrally positioned opening within at least one of the longitudinally extending side walls.

13. The portable container of claim 12 wherein the centrally positioned opening further comprises a door mounted for slidable transverse movement across the opening.

* * * * *